US008571248B2

(12) United States Patent
Li et al.

(10) Patent No.: US 8,571,248 B2
(45) Date of Patent: Oct. 29, 2013

(54) ELECTRONIC DEVICE WITH COVER HAVING INTERNAL PROTRUDING PORTIONS FOR DISPERSING OF SOUND

(75) Inventors: Min-Li Li, Shenzhen (CN); Ji-Feng Qiu, Shenzhen (CN); Ting-Ting Zhao, Shenzhen (CN); Hong Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 227 days.

(21) Appl. No.: 13/086,419

(22) Filed: Apr. 14, 2011

(65) Prior Publication Data

US 2012/0155687 A1 Jun. 21, 2012

(30) Foreign Application Priority Data

Dec. 17, 2010 (CN) ..... 2010 1 0593811

(51) Int. Cl.
*H04R 1/02* (2006.01)

(52) U.S. Cl.
USPC ..... 381/345; 181/198

(58) Field of Classification Search
USPC ..... 381/345, 386, 388, 196, 423, 150, 337, 381/160, 352, 354; 181/175, 198, 199, 293
See application file for complete search history.

(56) References Cited

U.S. PATENT DOCUMENTS

| | | | | |
|---|---|---|---|---|
| 6,058,315 | A * | 5/2000 | Clark | 455/575.1 |
| 6,863,152 | B1 * | 3/2005 | Sahyoun | 181/157 |
| 2005/0167188 | A1 * | 8/2005 | Aisenbrey | 181/199 |
| 2011/0308885 | A1 * | 12/2011 | Angelico | 181/294 |

* cited by examiner

*Primary Examiner* — Davetta W Goins
*Assistant Examiner* — Oyesola C Ojo
(74) *Attorney, Agent, or Firm* — Altis & Wispro Law Group, Inc.

(57) ABSTRACT

An exemplary electronic device includes a box, a speaker, and a micro structure. The box includes a shell and a cover disposed on the shell. The speaker is sandwiched between the shell and the cover. The micro structure includes a plurality of flat-bottomed protruding portions, a plurality of first pyramidal protruding portions, and a plurality of second pyramidal protruding portions.

18 Claims, 6 Drawing Sheets

ELECTRONIC DEVICE WITH COVER HAVING INTERNAL PROTRUDING PORTIONS FOR DISPERSING OF SOUND

BACKGROUND

1. Technical Field

The present disclosure relates to electronic devices, and particularly to an electronic device incorporating a speaker.

2. Description of Related Art

Portable electronic devices, such as notebooks, CD (Compact Disc) players, MP3 (Moving Picture Experts Group, audio layer 3) players and the like, have decreased both in size and weight over the past few years and are becoming ever more popular with travelers. The consumer demand for smaller size with ever-increasing capability has driven tremendous industry effort to continually seek to shrink many of the components contained within portable electronic devices.

Portable electronic devices being designed today require multi-media features in order to provide users with the same or similar enjoyable experience as that enjoyed with conventional high quality desktop and leisure systems. Thus, the sounds emanating from a portable electronic device should ideally be as harmonic as the original sound. The production of low frequency sounds requires a speaker or set of speakers to have a large acoustic chamber for the movement of a large mass of air. However, when a portable electronic device is reduced in size, the size of the acoustic chamber of a speaker set thereof is also accordingly reduced. This typically results in poorer overall sound quality, such as echoing.

What is needed, therefore, is an electronic device which can overcome the above-described problems.

BRIEF DESCRIPTION OF THE DRAWINGS

Many aspects of the present embodiments can be better understood with reference to the accompanying drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
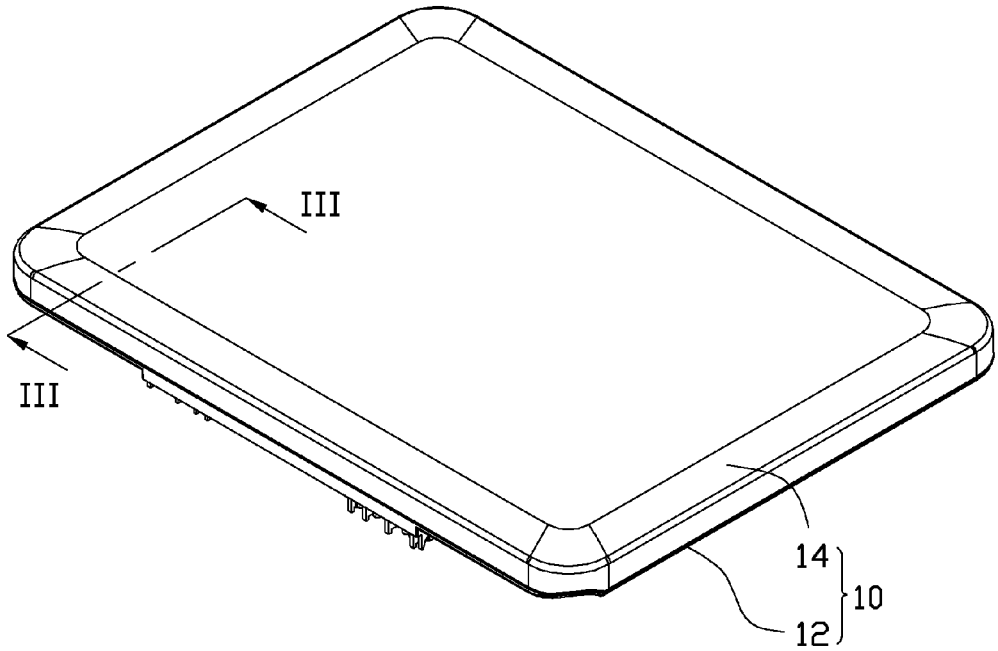
FIG. 1 is an assembled, isometric view of an electronic device in accordance with an embodiment of the disclosure.
Figure 2:
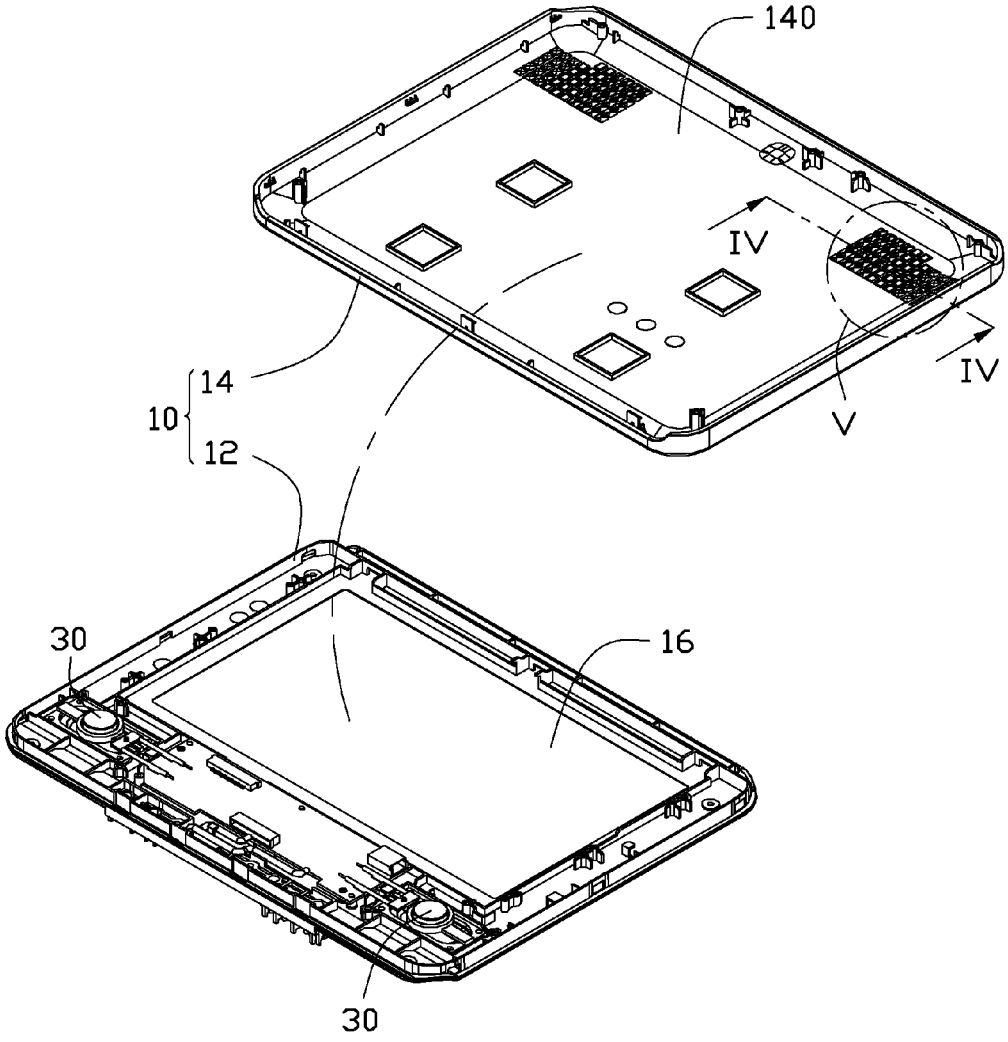
FIG. 2 is an exploded view of the electronic device of FIG. 1, showing a cover thereof inverted.

An electronic device in accordance with an exemplary embodiment of the disclosure is a portable DVD (Digital Video Disc) player. Referring to FIGS. 1 and 2, the electronic device comprises a generally cuboid box 10, a display panel 16 received in the box 10, at least a speaker 30 fixed in the box 10, and at least a micro structure 144 formed in the box 10 and located opposite to (facing) the at least a speaker 30. In this embodiment, there are two speakers 30 disposed near two opposite lateral sides of the box 10 respectively, and two corresponding micro structures 144.

Each speaker 30 comprises a sound membrane 32, and a motor 34 electrically driving the sound membrane 32. In this embodiment of the disclosure, the motor 34 is a voice coil motor.

Figure 3:
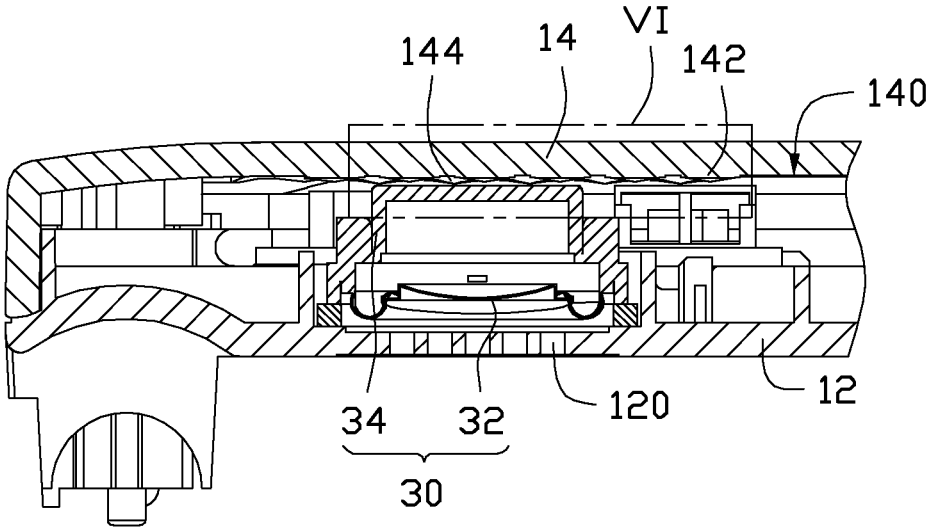
FIG. 3 is an enlarged, cross sectional view of part of the electronic device of FIG. 1, taken along line III-III thereof.

Referring to FIG. 3 also, the box 10 comprises a shell 12 and a cover 14 disposed on the shell 12. The speakers 30 are sandwiched between the shell 12 and the cover 14. The sound membrane 32 of each speaker 30 is close to the shell 12, and the motor 34 is close to the cover 14. The shell 12 defines an opening (not shown) at a center thereof for exposing the display panel 16. The shell 12 defines a plurality of sound holes 120 located corresponding to the two speakers 30.

Figure 6:
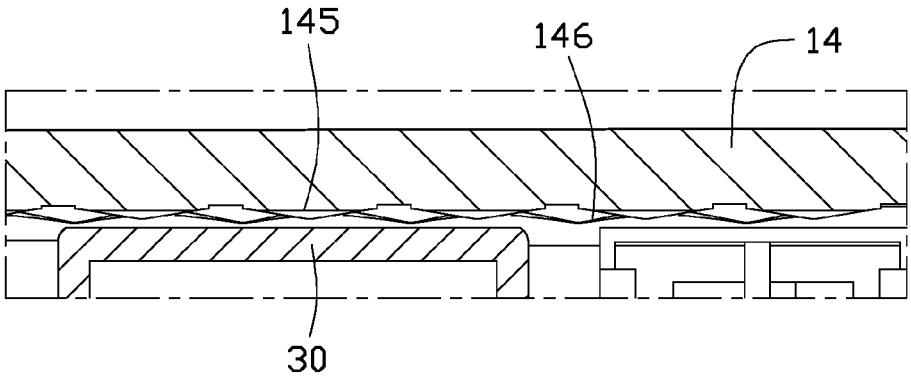
FIG. 6 is an enlarged view of a rectangular portion VI of FIG. 3.

When the cover 14 is fixed on the shell 12, an inner face 140 of the cover 14 is spaced a short distance from the speakers 30 (see FIG. 6). A protruding platform 142 protrudes downwards from the inner face 140 of the cover 14 towards each of the speakers 30. Each protruding platform 142 is located opposite to (facing) a corresponding speaker 30. A distance between the protruding platform 142 of the cover 14 and the motor 34 of the speaker 30 is not less than approximately 0.3 mm (millimeters), and preferably in the range of from approximately 0.4 mm to approximately 1.0 mm. In this embodiment of the disclosure, the distance between the protruding platform 142 and the motor 34 is about 0.4 mm.

Figure 4:
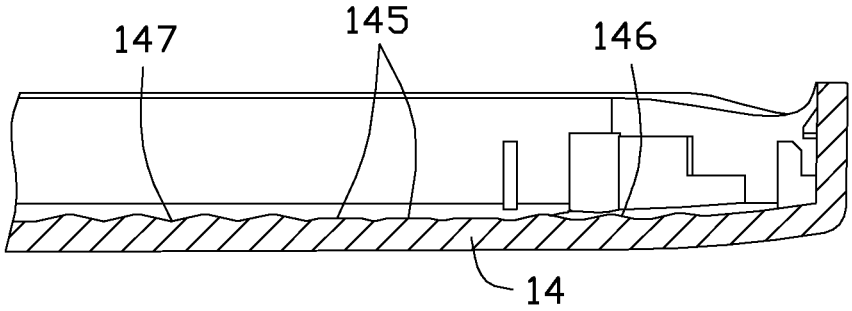
FIG. 4 is an enlarged, cross sectional view of part of the cover of FIG. 2, taken along line IV-IV thereof
Figure 5:
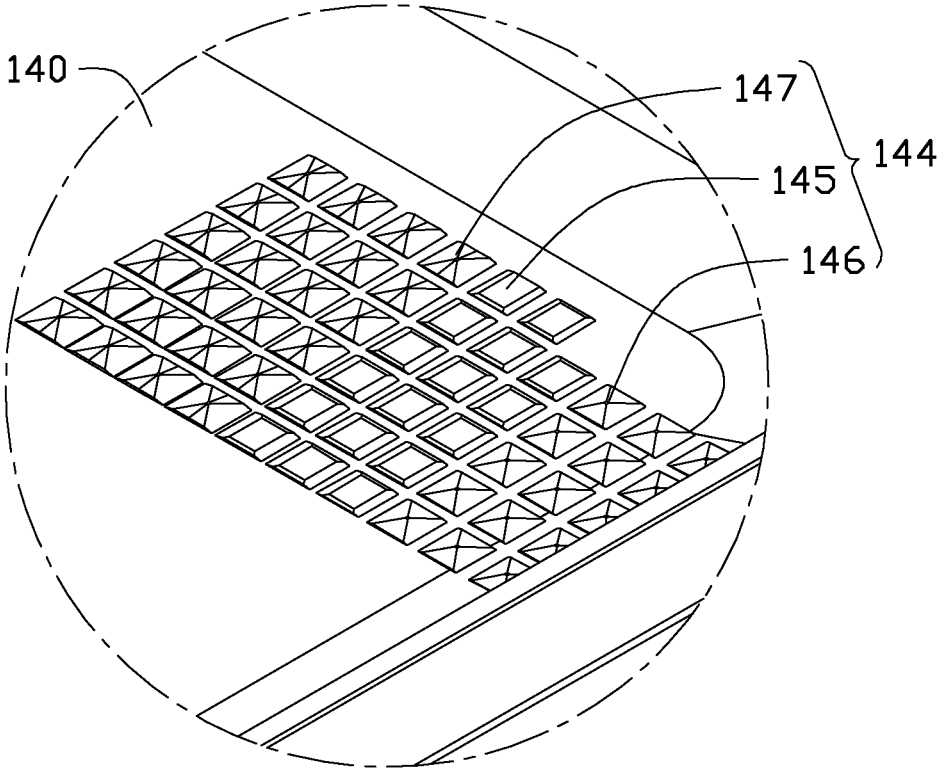
FIG. 5 is an enlarged view of a circled portion V of FIG. 2.

Referring to FIGS. 4-6, each micro structure 144 is formed on the corresponding protruding platform 142 of the cover 14. Considered another way, each micro structure 144 is formed as an integral part of the corresponding protruding platform 142. The micro structure 144 comprises a plurality of flat-bottomed protruding portions 145, a plurality of first pyramidal protruding portions 146, and a plurality of second pyramidal protruding portions 147. As shown in FIG. 5, the plurality of first pyramidal protruding portions 146 is located at one side of the plurality of flat-bottomed protruding portions 145, and the plurality of second pyramidal protruding portions 147 is located at an opposite side of the plurality of flat-bottomed protruding portions 145. The plurality of flat-bottomed protruding portions 145 is spaced from the plurality of first pyramidal protruding portions 146, and the plurality of flat-bottomed protruding portions 145 is also spaced from the plurality of second pyramidal protruding portions 147. The flat-bottomed protruding portions 145 are uniform, and are arranged in a generally regular array. Each two adjacent flat-bottomed protruding portions 145 are slightly spaced from each other. The first pyramidal protruding portions 146 are uniform, and are arranged in a regular array. Each two adjacent first pyramidal protruding portions 146 are slightly spaced from each other. The second pyramidal protruding portions 147 are uniform, and are arranged in a regular array. Each two adjacent second pyramidal protruding portions 147 are slightly spaced from each other.

Referring to FIGS. 3 and 6, each flat-bottomed protruding portion 145 has an approximately rectangular cross-section; and more particularly, has a substantially isosceles trapezoidal cross-section. Each first pyramidal protruding portion 146 has the shape of a square pyramid, which has a square base and four triangular lateral sides. Each second pyramidal protruding portion 147 has the shape of a polyhedron which resembles a square pyramid. In particular, the polyhedron has a square base and two opposite pentagonal lateral sides.

The flat-bottomed protruding portions 145 are located directly opposite (facing) a middle of the speaker 30. A height of each flat-bottomed protruding portion 145 is less than that of each first pyramidal protruding portion 146, and less than that of each second pyramidal protruding portion 147.

It can be understood that the profiles and the dimensions of the first pyramidal protruding portions 146 and/or the second pyramidal protruding portion 147 can be differently configured to meet the needs of various applications. In addition, in alternative embodiments, the micro structure 144 can include only flat-bottomed protruding portions 145, and completely omit the first and second pyramidal protruding portions 146, 147; or the micro structure 144 can include only first pyramidal protruding portions 146 and/or second pyramidal protruding portions 147, and completely omit the flat-bottomed protruding portions 145. Moreover, in further or other alternative embodiments, the micro structure 144 can be formed on the inner face 140 of the cover 14, instead of being formed on the protruding platform 142. That is, the protruding platform 142 can be omitted.

In use of each speaker 30 of the electronic device, the motor 34 electrically drives the sound membrane 32 to vibrate in order to generate sound waves. A part of the sound waves directly transmit through the sound holes 120 of the shell 12 to an outer environment, and another part of the sound waves transmit towards the inner face 140 of the cover 14 and the micro structure 144 formed on the inner face 140. These other sound waves are dispersed by the flat-bottomed protruding portions 145, and by the first pyramidal protruding portions 146 and the second pyramidal protruding portions 147. Thus, reflection of sound waves from the inner surface 140 of the cover 14 can be avoided.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic device comprising:

a box, comprising a shell and a cover disposed on the shell;

a speaker sandwiched between the shell and the cover; and a micro structure formed on an inner face of the cover and located opposite to the speaker, the micro structure comprising a plurality of flat-bottomed protruding portions protruding from the inner face of the cover towards the speaker, a plurality of first pyramidal protruding portions protruding from the inner face of the cover towards the speaker, and a plurality of second pyramidal protruding portions protruding from the inner face of the cover towards the speaker, wherein the flat-bottomed protruding portions are spaced from the first pyramidal protruding portions and the second pyramidal protruding portions.

2. The electronic device of claim 1, wherein the plurality of flat-bottomed protruding portions is located between the plurality of first pyramidal protruding portions and the plurality of second pyramidal protruding portions.

3. The electronic device of claim 2, wherein the flat-bottomed protruding portions directly face the speaker.

4. The electronic device of claim 1, wherein each first pyramidal protruding portion is in the shape of a square pyramid.

5. The electronic device of claim 1, wherein each second pyramidal protruding portion is in the shape of a polyhedron with a square base.

6. The electronic device of claim 1, wherein the micro structure is formed on a platform protruding downwards from the inner face of the cover towards the shell.

7. The electronic device of claim 6, wherein the micro structure is formed as an integral part of the protruding platform.

8. The electronic device of claim 1, wherein the speaker comprises a sound membrane and a motor for electrically driving the sound membrane.

9. The electronic device of claim 8, wherein the sound membrane is adjacent to the shell, and the motor is adjacent to the cover.

10. The electronic device of claim 1, wherein each flat-bottomed protruding portion has an isosceles trapezoidal cross-section.

11. An electronic device comprising:

a box, comprising a shell and a cover disposed on the shell;

a speaker sandwiched between the shell and the cover; and a micro structure formed on an inner face of the cover facing the speaker, the micro structure comprising a plurality of flat-bottomed protruding portions projecting towards the speaker, a plurality of first pyramidal protruding portions and a plurality of second pyramidal protruding portions protruding from the inner face of the cover towards the speaker, wherein the flat-bottomed protruding portions are spaced from the first pyramidal protruding portions and the second pyramidal protruding portions.

12. The electronic device of claim 11, wherein the flat-bottomed protruding portions are arranged between the first pyramidal protruding portions and the second pyramidal protruding portions.

13. The electronic device of claim 12, wherein the flat-bottomed protruding portions are located facing the speaker.

14. The electronic device of claim 12, wherein each first pyramidal protruding portion has a profile as a square pyramid.

15. The electronic device of claim 12, wherein each second pyramidal protruding portion has a profile as a polyhedron with a square base.

16. The electronic device of claim 12, wherein each of the protruding portions has a isosceles trapezoidal cross-section.

17. The electronic device of claim 16, wherein a height of each protruding portion is less than that of each first pyramidal protruding portion, or that of each second pyramidal protruding portion.

18. The electronic device of claim 11, wherein the flat-bottomed protruding portions are uniform and arranged in a general regular array.

* * * * *